US010597830B1

(12) United States Patent
Lemons

(10) Patent No.: US 10,597,830 B1
(45) Date of Patent: Mar. 24, 2020

(54) APPARATUS, SYSTEM, AND METHOD FOR PROVIDING DRAINAGE OF A SURFACE LAYER

(71) Applicant: Gerald Lynn Lemons, Old Hickory, TN (US)

(72) Inventor: Gerald Lynn Lemons, Old Hickory, TN (US)

( * ) Notice: Subject to any disclaimer, the term of this patent is extended or adjusted under 35 U.S.C. 154(b) by 0 days.

(21) Appl. No.: 16/211,629

(22) Filed: Dec. 6, 2018

(51) Int. Cl.

| | |
|---|---|
| ***E02B 11/00*** | (2006.01) |
| ***E01C 13/02*** | (2006.01) |
| *E01C 13/08* | (2006.01) |
| *A63B 69/36* | (2006.01) |

(52) U.S. Cl.
CPC ..... *E01C 13/02* (2013.01); *E02B 11/005* (2013.01); *A63B 69/3691* (2013.01); *E01C 13/083* (2013.01)

(58) Field of Classification Search
CPC ... A63B 69/3691; E02B 11/00; E02B 11/005; E01C 13/02; E01C 13/083
USPC ..... 405/43, 44, 45, 50
See application file for complete search history.

(56) References Cited

U.S. PATENT DOCUMENTS

| | | | | | |
|---|---|---|---|---|---|
| 3,936,380 | A * | 2/1976 | Boske | C02F 1/688 | 210/170.07 |
| 4,650,367 | A * | 3/1987 | Dietzler | E02B 11/00 | 405/43 |
| 4,679,963 | A * | 7/1987 | Heath | E01C 13/02 | 405/36 |
| 4,832,526 | A * | 5/1989 | Funkhouser, Jr. | E01C 13/02 | 405/36 |
| 4,913,596 | A * | 4/1990 | Lambert, III | E01C 13/083 | 405/36 |
| 4,960,345 | A * | 10/1990 | Hurley | E01C 13/02 | 405/258.1 |
| 5,219,243 | A * | 6/1993 | McCoy | A01G 25/00 | 405/36 |
| 5,458,436 | A * | 10/1995 | Plowman | E01C 13/02 | 405/36 |
| 5,848,856 | A | 12/1998 | Bohnhoff | | |
| 7,014,390 | B1 | 3/2006 | Morris | | |
| 7,114,877 | B2 | 10/2006 | Wilkerson | | |
| 7,147,401 | B2 * | 12/2006 | Wickens | E01C 13/08 | 405/45 |
| 7,207,747 | B1 * | 4/2007 | England | E01C 13/02 | 210/170.01 |
| 7,399,145 | B2 | 7/2008 | Clark | | |

(Continued)

FOREIGN PATENT DOCUMENTS

| | | |
|---|---|---|
| FR | 3049964 | 10/2017 |
| WO | 2010034591 | 4/2010 |
| WO | 2012046014 | 4/2012 |

*Primary Examiner* — Frederick L Lagman
(74) *Attorney, Agent, or Firm* — Ellenoff Grossman & Schole LLP; James M. Smedley; Alex Korona

(57) ABSTRACT

A drainage assembly is disclosed. The drainage assembly has a subgrade material having a bottom surface and at least one side surface that forms an angle with the bottom surface, a first layer of a first material disposed on the bottom surface and the at least one side surface, a passage disposed on or in the first layer, and a second layer of a second material disposed above the passage and the first layer. The first material is coarser than the second material. An angle of repose of the second material is equal to or steeper than the angle.

15 Claims, 10 Drawing Sheets

(56) References Cited

U.S. PATENT DOCUMENTS

| | | | | |
|---|---|---|---|---|
| 7,909,535 | B2 * | 3/2011 | Samara | E03B 3/16 138/140 |
| 8,062,143 | B1 | 11/2011 | Meersman | |
| 8,529,159 | B2 * | 9/2013 | Lemons | A63B 69/3691 405/302.6 |
| 9,795,854 | B1 * | 10/2017 | Jones | A63B 69/3691 |
| 2002/0172557 | A1 * | 11/2002 | Chen | E02B 11/005 405/43 |
| 2003/0177799 | A1 * | 9/2003 | Park | E01C 13/083 71/903 |
| 2006/0051161 | A1 * | 3/2006 | Benson | E01C 13/02 405/43 |
| 2006/0280557 | A1 * | 12/2006 | Ring | E02B 11/005 405/43 |
| 2007/0278142 | A1 | 12/2007 | Clark | |
| 2013/0156511 | A1 | 6/2013 | Chang | |
| 2013/0184090 | A1 | 7/2013 | Sternberg | |
| 2014/0037380 | A1 | 2/2014 | Speiden | |
| 2015/0056017 | A1 * | 2/2015 | Lemons | A63B 69/3691 405/43 |
| 2016/0177525 | A1 * | 6/2016 | Holbrook | E03F 1/003 405/45 |
| 2017/0191230 | A1 | 7/2017 | Doble | |
| 2017/0225051 | A1 | 8/2017 | Lemons | |
| 2018/0021654 | A1 * | 1/2018 | Doble | E01C 13/02 473/173 |

* cited by examiner

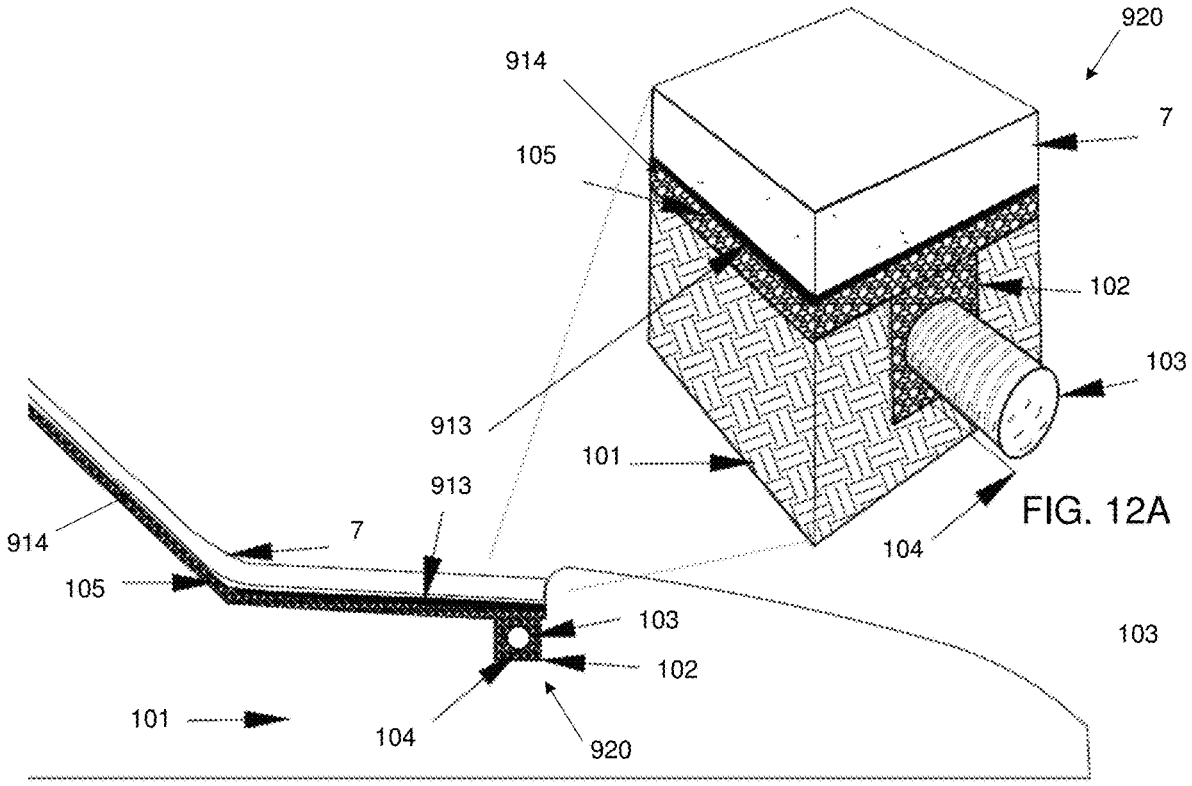
FIG. 12A
FIG. 12B
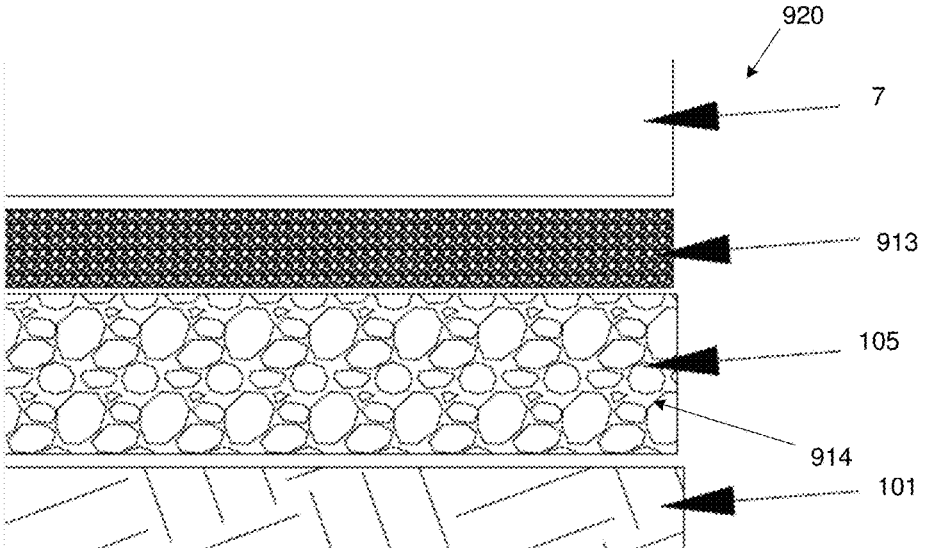
FIG. 13

APPARATUS, SYSTEM, AND METHOD FOR PROVIDING DRAINAGE OF A SURFACE LAYER

TECHNICAL FIELD

The present disclosure generally relates to an apparatus, system, and method for providing drainage, and more particularly to an apparatus, system, and method for providing drainage of a surface layer.

BACKGROUND

Sports fields are typically designed to have suitable compaction, drainage, and water management attributes. In many regions around the world, sports fields surfaces are built with multiple layers of aggregate materials that help to improve the speed of water to drain through these layers and for suitable water retention so as not to involve significant irrigation of turf.

When using sandy type soils disposed over a relatively coarser gravel layer, a perched water table is typically formed. This practice, developed by Dr. Marvin Ferguson and the United States Golf Association, has evolved in construction specifications since the early 1960s as a method called the USGA Green construction Method. This and similar methods have been used in golf greens and sports fields. Other Methods such as the Prescription Athletic Field ("PAT") system evolved from this practice, with golf bunker construction using drainage layers and liners that employ a coarse aggregate below the sandy soil as a technique for providing fast drainage.

A perched water table of the above-described designs may allow a surface layer to drain and may retain water between rain events or irrigation cycles so that less water is used in irrigation and turfgrass can survive in droughts. A perched water table can be used in playing surfaces in areas such as golf sand bunkers.

When golf bunker sand is wet, it is typically firmer. By retaining moisture, the bunker does not have as many undesirable buried or "fried egg lies" when a golf ball lands in the bunker. These buried lies are typically undesirable for golfers.

Very wet playing surfaces are typically undesirable and may cause various problems. For turf surfaces, prolonged existence of excessive water is not good for the turf and can accelerate disease and anaerobic conditions, which may cause quick turf decline. Water may move relatively slower when moving laterally in sand, making low areas on putting greens more difficult to manage due to having excessive water compared to relatively higher locations on the playing surfaces. This issue may also occur on sports fields that are crowned or pitched. For example, golf bunkers that are flat and sloped may be wetter in its low areas where most golf shots are hit from. If sand is too shallow, or a recent rain event or irrigation has occurred, the sand's playing surface may be less desirable. A relatively fast draining system, such as a USGA green or sports fields using a gravel layer below the playing surface soil may hold excessive moisture immediately after a rain or irrigation event due to perching of water in sand disposed over the gravel layer. In climates where evaporation is relatively slow, sand disposed in playing surface layers may not dry fast enough in its low levels. Providing suitable speed or time of drying after these rain cycles in order to achieve suitable playing surface conditions is typically a problem.

If a sandy soil sits over relatively coarse soil, a perched water table typically occurs. Such a soil that has received adequate water to fill the entire profile is at field capacity. When a perched water table exists, the soil stops draining and remains at field capacity. The amount of time in which gravity can pull the water down and achieve the desired moisture in these sports surfaces is longer in the relatively lower areas of conventional systems, which may result in playing surfaces being wetter than desired and being unsuitable for growing turf or playing sports.

Due to gravity and a lateral movement of water through sands, surface layers are typically wetter in low areas than in higher sections. The amount of time it may take for a playing surface to become drier affects suitability for playing. Conventional techniques show that removing water from the surface and subsurface drainage and proper design of drainage devices such as pipes may provide a good playing surface. This "Stormwater" design is calculatable to determine pipe sizes for collection and removal of water from a playing surface site. Subsurface water calculation is determined by the layers of a surface. A percolation rate of the top layers dictates how quickly water moves into the next layer. Gravitational pull being consistent, as long as the layer of aggregates below is larger than aggregates above, water will move downward vertically while the soil is saturated or above field capacity until the upper soil reaches field capacity. When the layer of aggregates of the upper soil is smaller than the next lowest layer, a perched water table will exist and the soil will remain at a field capacity, totally saturating the two layers. The soil will remain at field capacity and stop releasing water until additional water enters the soil from above and then it will release water based on a 1:1 ratio. Drainage devices such as pipes may release water faster. A perched water table slows the drying of the soils in the lower levels of playing surfaces because of the speed in which sand moves water laterally over these perched water tables (e.g., because the space below is void of air). Increasing the depth of sand in playing surfaces or eliminating perched water may speed drying, but are costly.

It is beneficial for playing surfaces to have relatively quick draining characteristics in its relatively low areas during heavy rain seasons or heavy irrigation cycles (e.g., in coastal areas where summer rains can occur daily). When these seasonal rains occur, systems that perch water may remain at field capacity based on the speed in which the sand layer can drain and release the water (e.g., percolation rate) to the gravel layer.

Concerns may also exist involving conventional gravel bridging with existing subgrade soils. If a subgrade is relatively fine and does not bridge with the aggregate, the fines may clog a drain pipe.

Another problem involves surface layers being irrigated with effluent water and/or using high fertility. A sports-turf sandy soil may begin to drain slower soon after construction, resulting in a surface involving additional cultivational practices such as coring and raking to assist in improving drying of the surfaces. When such soils remain excessively wet, additional issues such as turf disease, root rotting, algae, and anaerobic conditions may occur. These additional issues may compound problems by changing the way in which the soil drains. Sands, which may have drained relatively quickly initially, may become contaminated in less than a year and perform 25% or less of the original drainage percolation rates or capacity.

A further problem associated with sports fields is that drainage in relatively higher locations is typically faster than relatively lower areas due to relatively slower movement of water in a sand layer laterally toward relatively lower regions. When a perched water table occurs, the relatively lower areas of the sports field may be wetter. Another problem involving sports fields may be that some areas (e.g., golf bunkers) may not be flat and soils in this area may be unstable.

The exemplary disclosed apparatus, system, and method of the present disclosure is directed to overcoming one or more of the shortcomings set forth above and/or other deficiencies in existing technology.

SUMMARY OF THE DISCLOSURE

In one exemplary aspect, the present disclosure is directed to a drainage assembly. The drainage assembly includes a subgrade material having a bottom surface and at least one side surface that forms an angle with the bottom surface, a first layer of a first material disposed on the bottom surface and the at least one side surface, a passage disposed on or in the first layer, and a second layer of a second material disposed above the passage and the first layer. The first material is coarser than the second material. An angle of repose of the second material is equal to or steeper than the angle.

In another aspect, the present disclosure is directed to a drainage assembly. The drainage assembly includes a subgrade material having a bottom surface and a first side surface that forms a first angle with the bottom surface and a second side surface that forms a second angle with the bottom surface, a first layer of a first material disposed on the bottom surface, the first side surface, and the second side surface, a passage disposed on or in the first layer, an intermediate layer of an intermediate material disposed on the first layer, and a second layer of a second material disposed on the passage and the intermediate layer. The first material is coarser than the intermediate layer, and the intermediate layer is coarser than the second material. The first angle and the second angle are both less than or equal to an angle of repose of the second material.

BRIEF DESCRIPTION OF THE DRAWINGS

FIG. 12A is a perspective view of at least some exemplary embodiments of the present invention;

FIG. 12B is a sectional view of at least some exemplary embodiments of the present invention;

FIG. 13 is a sectional view of at least some exemplary embodiments of the present invention;

DETAILED DESCRIPTION AND INDUSTRIAL APPLICABILITY

Figure 1A:
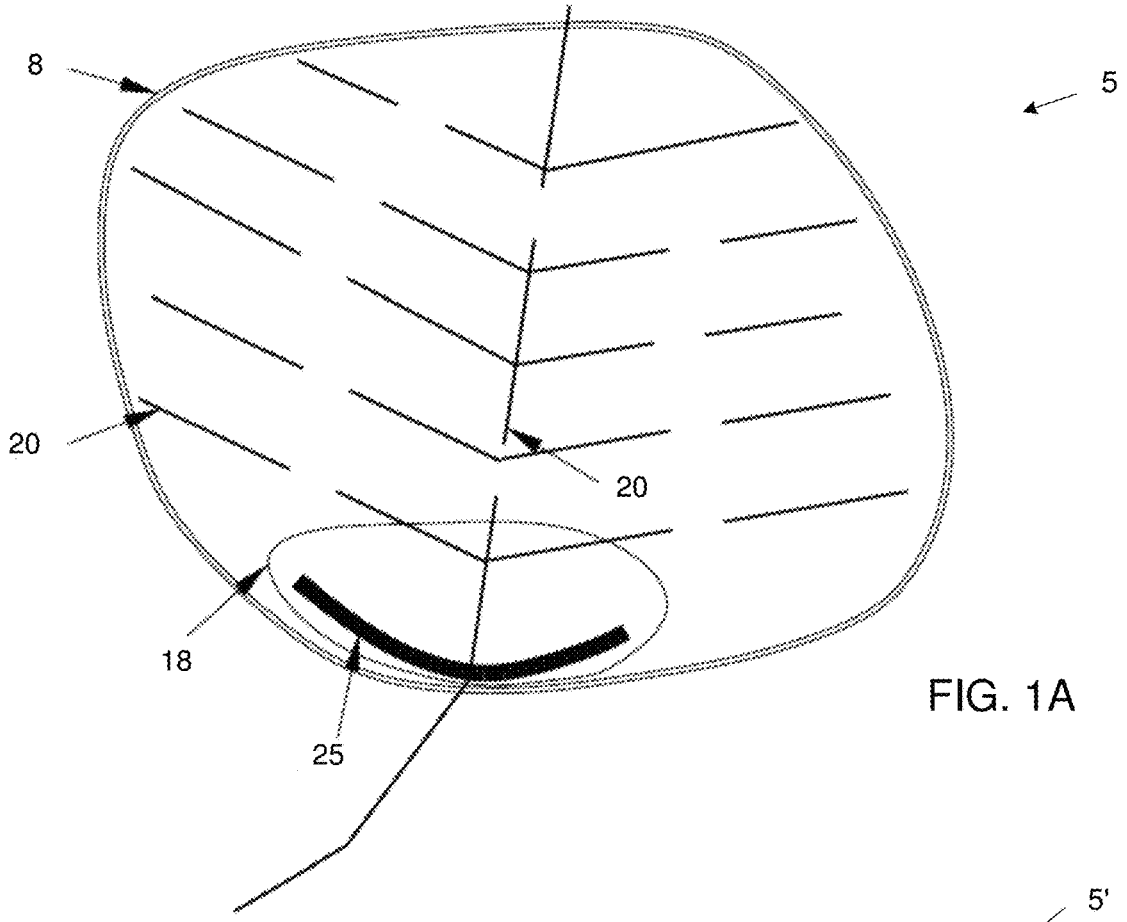
FIG. 1A is a plan view of at least some exemplary embodiments of the present invention.
Figure 1B:
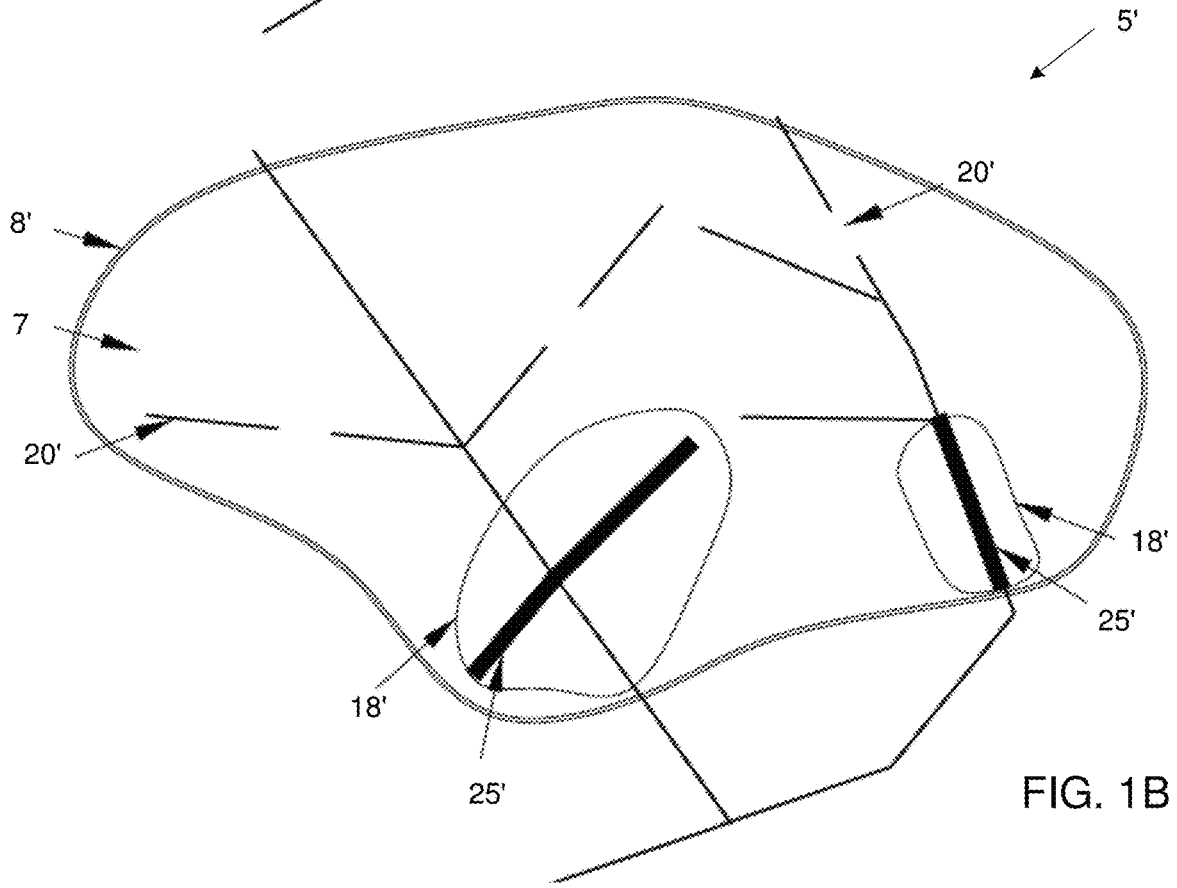
FIG. 1B is a plan view of at least some exemplary embodiments of the present invention.

FIGS. 1A and 1B illustrate exemplary embodiments of an exemplary disclosed surface layer. The exemplary disclosed surface layer may be a playing surface layer such as a surface layer of a sports field, golf course, and/or other suitable surface. For example, the exemplary disclosed surface layer may be a surface layer of a golf putting green, a golf sand trap, a golf bunker, a golf tee green, and/or a golf fairway.

FIG. 1A illustrates a surface layer 5 that may be for example a surface layer of a golf putting green or any other suitable playing field. Surface layer 5 may include a perimeter portion 8, one or more portions 18, a plurality of drainage assemblies 20, and one or more drainage assemblies 25. Perimeter portion 8 may be disposed at a perimeter of surface layer 5. The one or more portions 18, the plurality of drainage assemblies 20, and the one or more drainage assemblies 25 may be disposed in surface layer 5.

As illustrated in FIG. 1A, perimeter portion 8 may be a border of a cavity in which surface layer 5 is disposed. Perimeter portion 8 may be a substantially flat border of surface layer 5 that may be a golf putting green. Perimeter portion 8 may for example be a turf material (e.g., synthetic turf material) or similar material that is suitable for forming a border of a playing surface such as a golf putting green.

As illustrated in FIG. 1A, the plurality of drainage assemblies 20 may be disposed in any desired pattern in surface layer 5. In at least some exemplary embodiments, the plurality of drainage assemblies 20 may be disposed across a length and width of surface layer 5, and may be spaced from each other at substantially constant and/or varying distances. The plurality of drainage assemblies 20 may form any suitable pattern for providing drainage of surface layer 5.

Portion 18 may be a portion of surface layer 5 that is lower (e.g., has a lower elevation) than other portions of surface layer 5. In at least some exemplary embodiments, portion 18 may form a depression in surface layer 5. A surface of portion 18 may be lower (e.g., have a lower elevation) than a surface of the other portions of surface layer 5. One or more portions 18 may be the lowest portion (e.g., or portions) of surface layer 5.

The one or more drainage assemblies 25 may be disposed in portion 18. For example, the one or more drainage assemblies 25 may be disposed in a lowest portion of surface layer 5. The one or more drainage assemblies 25 may be fluidly connected to the plurality of drainage assemblies 20 so that fluid that is transported (e.g., water that is drained) by the one or more drainage assemblies 25 may pass into and be drained by the plurality of drainage assemblies 20. In addition to water being transported, it is contemplated that any desired liquid and/or gaseous fluid may be transported via drainage assemblies 25 such as, for example, water, chemicals, and/or any other suitable fluid that may be transferred through a surface layer.

FIG. 1B illustrates another exemplary embodiment of the exemplary disclosed surface layer. Surface layer 5' may be for example a surface layer of a golf sand bunker or any other suitable playing field including a material 7 such as sand (e.g., or any other suitable aggregate such as coarse and/or fine aggregate). Material 7 may include for example, sand, sand mix, crumb rubber, gravel, rock, stone, porcelain, and/or any other suitable aggregate or granular material. For example, material 7 may be sand or sand mix for use on turf sports fields. Material 7 may be golf bunker sand. It is also contemplated that surface layer 5 may include material 7. Material 7 may provide a layer of any desired depth such as, for example, between about 4 inches and about 6 inches or more.

Surface layer 5' may include a perimeter portion 8', one or more portions 18' that may be similar to portions 18, a plurality of drainage assemblies 20' that may be similar to drainage assemblies 20, and one or more drainage assemblies 25' that may be similar to drainage assemblies 25. Perimeter portion 8' may be disposed at a perimeter of surface layer 5'. The one or more portions 18', the plurality of drainage assemblies 20', and the one or more drainage assemblies 25' may be disposed in surface layer 5'.

As illustrated in FIG. 1B, perimeter portion 8' may be a border of a cavity in which surface layer 5' is disposed. Perimeter portion 8' may be a substantially flat border and/or a steep border of surface layer 5' that may be a golf sand bunker. Perimeter portion 8' may be formed from similar material as perimeter portion 8.

Figures 2A, 2B:
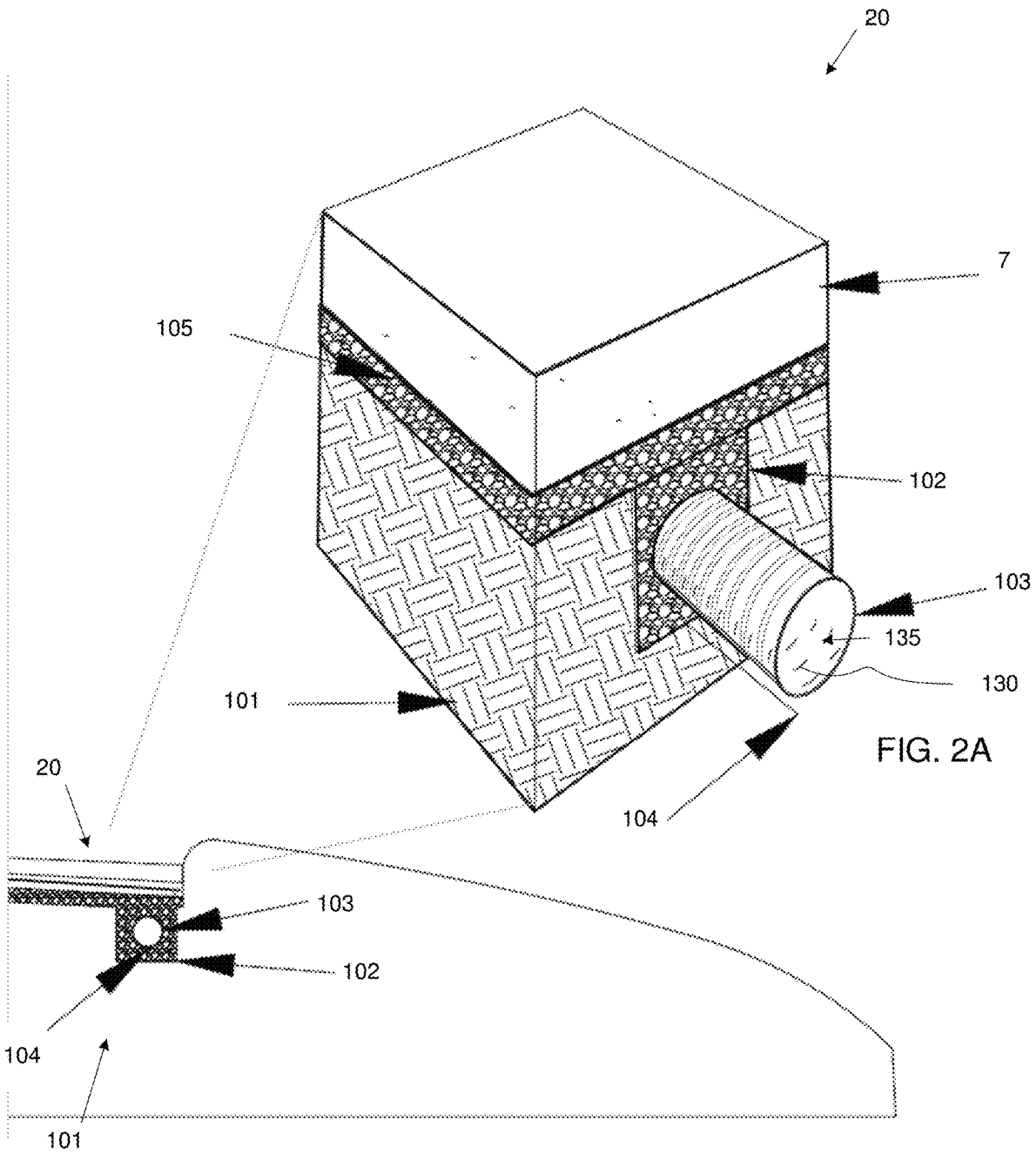
FIG. 2A is a perspective view of at least some exemplary embodiments of the present invention.
FIG. 2B is a sectional view of at least some exemplary embodiments of the present invention.

FIGS. 2A and 2B illustrate an exemplary embodiment of drainage assembly 20, to which drainage assembly 20' may be similar. Drainage assembly 20 may be supported by and/or include a material 101 of surface layer 5. Material 101 may be for example a subgrade of surface layer 5. In at least some exemplary embodiments, material 101 may be soil (e.g., in situ soil) or earth or any other suitable material that may provide subgrade support for surface layer 5.

A cavity 102 may be formed in material 101. Cavity 102 may be configured to receive a passage 103 and/or a material 105. Cavity 102 may be for example a trench or other suitable cavity for receiving passage 103 and/or material 105. For example, cavity 102 may be an excavated drainage trench.

Passage 103 may be any suitable passage for transferring a fluid such as water (e.g., drainage water). Passage 103 may be formed from any suitable material such as plastic (e.g., Polyvinyl chloride or any other suitable polymer or plastic), metal (e.g., steel or aluminum), composite material, and/or any other suitable material for transferring a fluid. Passage 103 may include a plurality of apertures 130 (e.g., passage 103 may be perforated) to allow a movement of fluid into a cavity 135 (e.g., interior passageway, channel, or any other suitable cavity) of passage 103. For example, apertures 130 may be slots, holes, or channels that are disposed in passage 103. Passage 103 may be for example a pipe such as a drainage pipe. Passage 103 may be formed from one or more drain tiles and/or any other suitable structural members for supporting material 105 while receiving a flow of fluid from material 105 into an interior cavity of passage 103. Passage 103 may have any suitable dimensions such as, for example, a diameter (e.g., or width) of between about 2 inches and about 18 inches, between about 2 inches and about 12 inches, between about 2 inches and about 6 inches, between about 3 inches and about 5 inches, about 4 inches, and/or any other suitable dimensions to allow a flow of fluid such as drainage water.

Material 105 may be any suitable material for being disposed in cavity 102, to surround and support passage 103 within cavity 102, and/or to cover an exterior surface of material 101 with a layer of material 105. For example, cavity 102 may be an excavated drainage trench that is wide enough to receive passage 103 that may be surrounded by material 105. Material 105 may be any suitable material for surrounding passage 103 such as, for example, coarse aggregate such as gravel (e.g., gravel aggregate). Material 105 may also be any suitable material for providing support to passage 103 within cavity 102 while allowing a flow of fluid such as drainage water through material 105. In at least some exemplary embodiments, material 105 may be gravel such as pea gravel and/or similar material. Material 105 may for example be an aggregate layer or a gravel layer. Material 105 may be treated with any desired binder or similar material to stabilize a movement of components (e.g., granular components) of material 105 relative to each other (e.g., may reduce or substantially prevent a movement of components of material 105 relative to each other). For example, material 105 may be treated with polymer, asphaltic compounds, cement, concrete, and/or any other suitable binder.

As illustrated in FIG. 2A, a member 104 may be disposed in material 105 that is supported in cavity 102. Member 104 may be any suitable elongated member that may be used to locate passage 103 when passage 103 has been covered as described below. Member 104 may be an elongated metallic member. For example, member 104 may be wire such as insulated wire. In at least some exemplary embodiments, member 104 may be an insulated 14 gauge wire or any other suitable member of any suitable gauge or size.

As illustrated in FIG. 2A, material 105 may be disposed in cavity 102 (e.g., above, surrounding, and/or above passage 103). A layer of material 105 may also be disposed above material 101. Material 105 disposed within cavity 102 and above material 101 may be similar or may be different (e.g., include different exemplary materials of material 105 described above). A layer of material 7 may be disposed above the layer of material 105 as illustrated in FIG. 2A. For example, material 7 may be placed above material 105 after the exemplary binder applied to material 105 (e.g., as described above) has cured.

Figure 3:
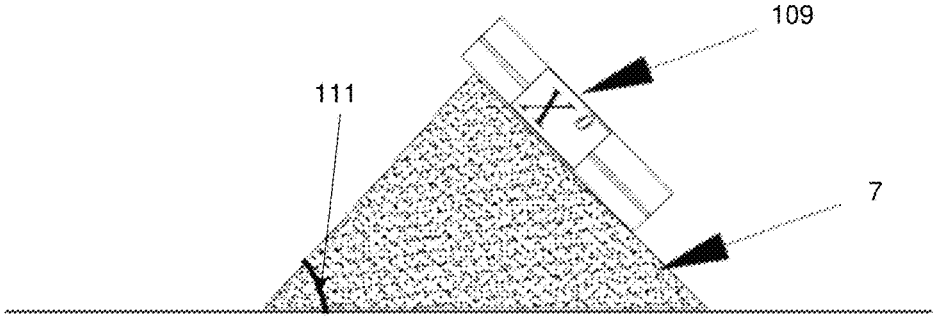
FIG. 3 is a schematic illustration of at least some exemplary embodiments of the present invention.

FIG. 3 illustrates a profile side view of a pile of material 7 that may be any suitable material as described for example above (e.g., sand, drainage gravel, and/or any other suitable aggregate or material). Any suitable device 109 may be used to measure an angle of repose 111 of the exemplary pile of material 7. Device 109 may be any suitable instrument for measuring an angle of repose of a granular material. Device 109 may be a digital or analog reading device or any other suitable measurement device. For example, device 109 may be any suitable mechanical or electro-mechanical instrument for measuring an angle of repose. Device 109 may be used to measure an angle of repose of material 7 illustrated in FIGS. 1B and 2A. device 109 may also make exemplary measurements as described below regarding FIG. 4.

Figure 4:
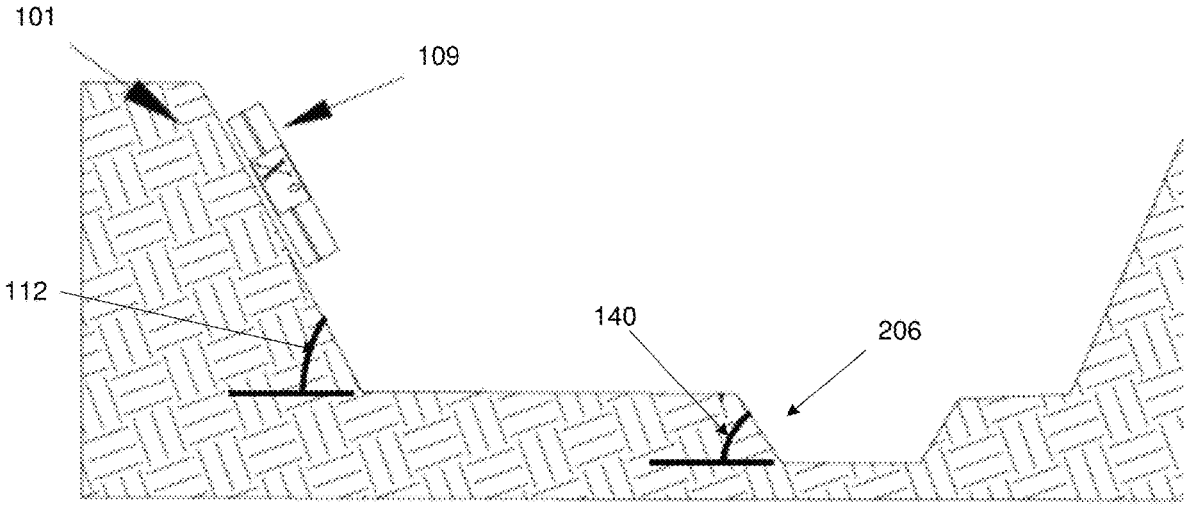
FIG. 4 is a schematic illustration of at least some exemplary embodiments of the present invention.

FIG. 4 illustrates a profile side view of an exemplary surface (e.g., a golf bunker) having an exemplary cavity including material 101 that may be a subgrade material and drainage assembly 25 including an exemplary drain trench. In at least some exemplary embodiments, an angle 140 of the exemplary drain trench of drainage assembly 25 (e.g., or drainage assembly 25') and/or an angle 112 of material 101 as illustrated in FIG. 4 may be no steeper than an angle of repose 111 of material 7 as illustrated in FIG. 3. Angle 112 and/or angle 140 of the exemplary drain trench of drainage assembly 25 may be measured similarly to the measurement of angle of repose 111 via device 109 as described above regarding FIG. 3.

Figures 5A, 5B:
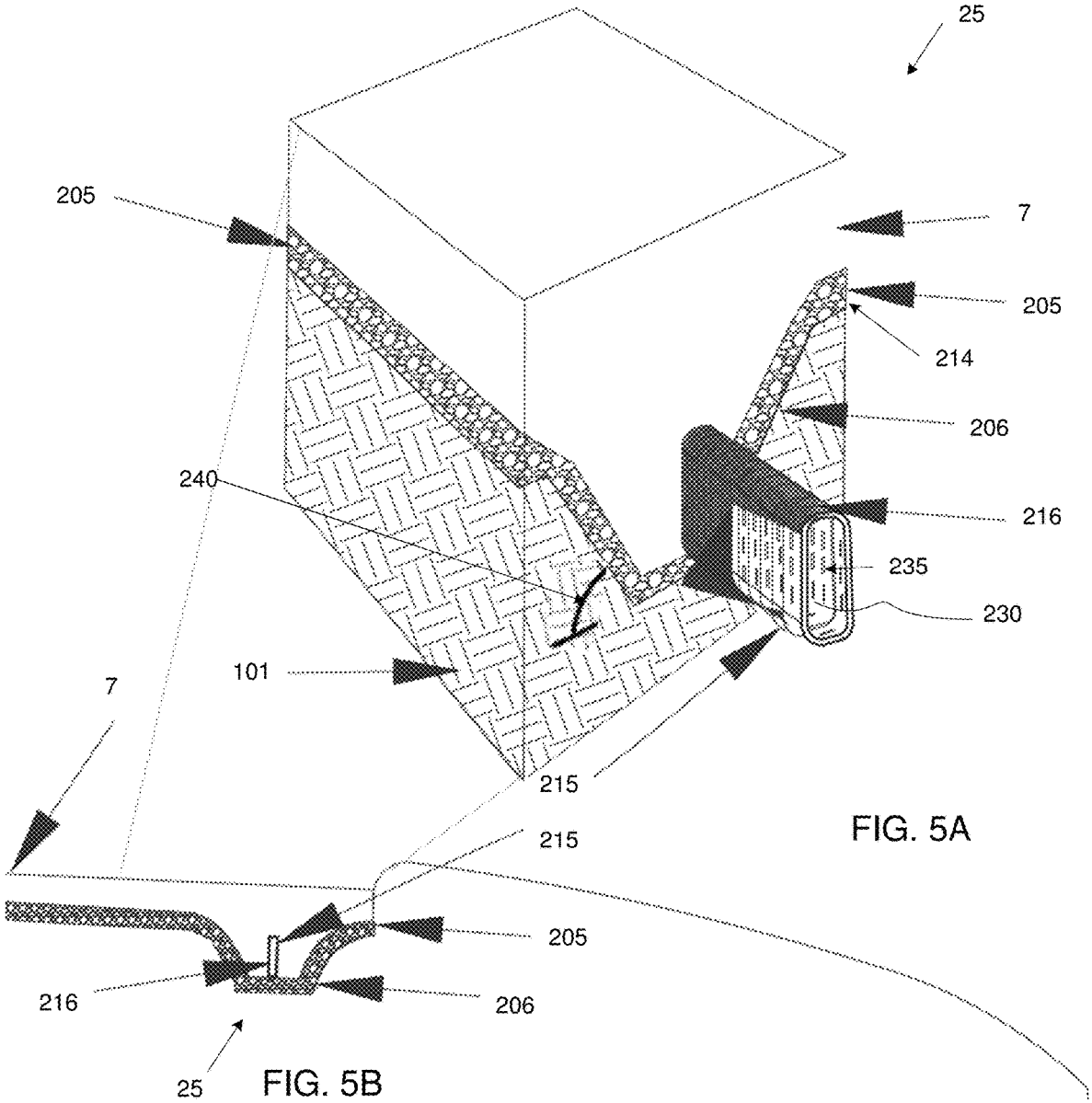
FIG. 5A is a perspective view of at least some exemplary embodiments of the present invention.
FIG. 5B is a sectional view of at least some exemplary embodiments of the present invention.

FIGS. 5A and 5B illustrate a perspective and sectional view of drainage assembly 25 (drainage assembly 25' may be similar). Drainage assembly 25 may include a material 205, a cavity 206, and a passage 215. Material 205 and passage 215 may be disposed in cavity 206.

Cavity 206 may be formed in material 101. Cavity 206 may be configured to receive material 205, material 7, and/or passage 215. Cavity 206 may be for example a trench or other suitable cavity for receiving material 205, material 7, and/or passage 215. For example, cavity 206 may be an excavated drainage trench. Cavity 206 may be formed to have an angle 240 that may be similarly configured as angle 140 described above. Angle 240 may be an angle formed between a horizontal plane and an adjacent side surface of cavity 206 (e.g., a surface of material 205) as illustrated in FIGS. 5A and 5B. Angle 240 may be no steeper than angle of repose 111 of material 7 described for example above regarding FIG. 3. For example, angle 240 may be no steeper than angle of repose 111 as measured by device 109. Angle 240, angle 112, and/or angle 140 may be less than or equal to angle of repose 111. For example, angle 240 may be less than or equal to angle of repose 111 (e.g., as the value of the exemplary angle increases, the angle may become steeper). Angle 240 may be any suitable angle for providing a configuration for drainage assembly 25. Angle 240 may be less than or equal to 45 degrees. In at least some exemplary embodiments, angle 240 may be less than or equal to 35 degrees. Also for example, angle 240 may be no steeper than angle 112 as illustrated in FIG. 4. In at least some exemplary embodiments, angle 240 may be based on an angle of repose of material 205 (e.g., about equal to an angle of repose of material 205 or no steeper than an angle of repose of material 205, and/or no steeper than an angle of repose of material 7).

As illustrated in FIGS. 5A and 5B, cavity 206 may be configured (e.g., cavity 206 including a layer of material 205) to be wide enough to receive passage 215 that may be surrounded by material 7 (e.g., sand or any other suitable material as described for example above). For example, passage 215 may be disposed in cavity 206 (e.g., above a layer of material 205) and surrounded by material 7.

Cavity 206 may have any suitable width (e.g., minimum width) that is suitable based on an angle of repose of material 205 (e.g., and/or based on an angle of repose of material 7). Cavity 206 may have a total depth of 12 inches or more. For example, cavity 206 may have a suitable depth including a depth of 2 inches or more of material 205, a height of passage 215, and a depth of about 6 inches or more of material 7. The depths of the exemplary layers of material 205 and material 7 may be any desired depth (e.g., between one or several inches and one or several feet). Material 205 may form a layer (e.g., a relatively thin layer) that may be applied to material 101 (e.g., a subgrade) to stabilize relatively steep areas of a surface layer such as a sports field and to control a drying effectiveness in these areas as described for example herein.

Material 205 may be similar to material 105 described above. In at least some exemplary embodiments, material 205 may form an aggregate layer (e.g., a gravel aggregate layer). The exemplary layer of material 205 illustrated in FIGS. 5A and 5B may be at least 1 inch (e.g., between about 2 inches and about 6 inches or more). Material 205 may be treated with a binder material 214. For example, material 205 may be bound with binder material 214 for stabilization of material 205. Binder material 214 may be any suitable binder or similar material that may stabilize a movement of components (e.g., granular components) of material 205 relative to each other (e.g., may reduce or substantially prevent a movement of components of material 205 relative to each other). For example, binder material 214 may be a polymer binder, asphaltic compounds, cement, concrete, and/or any other suitable binder. Binder material 214 may be applied to material 205 by any suitable technique such as, for example, spraying, brushing, dipping, mixing, and/or any other suitable application technique. For example, binder material 214 and material 205 may be mixed onsite or offsite. In at least some exemplary embodiments, binder material 214 may be a polymer that is sprayed on material 205. In at least some exemplary embodiments, material 205 may be treated with binder material 214 when a slope of a surface of material 101 (e.g., on which material 205 may be disposed) and/or a slope of material 205 is greater than 2%. In at least some exemplary embodiments, material 205 may be treated with binder material 214 when material 7 disposed on material 105 has a depth of about 7" or less. Material 205 may be coarser than material 7. For example, material 205 may be a gravel that is coarser than material 7 that may be a sand.

Passage 215 may be any suitable passage for transferring a fluid such as water (e.g., drainage water). Passage 215 may be formed from any suitable material such as, for example, material similar to passage 103 described above. Passage 215 may have any suitable shape and dimensions such as, for example, dimensions similar to passage 103 described above. Passage 215 may include a plurality of apertures 230 (e.g., may be perforated) to allow a movement of fluid into a cavity 235 (e.g., interior passageway, channel, or any other suitable cavity) of passage 215. For example, apertures 230 may be slots, holes, or channels that are disposed in passage 215. Passage 215 may be for example a pipe such as a drainage pipe. In at least some exemplary embodiments, passage 215 may be formed from one or more drain tiles and/or any other suitable structural members for supporting material 7 while receiving a flow of fluid from material 7 and/or material 205.

A material 216 may be disposed on passage 215. Material 216 may be a membrane that partially or substantially entirely surrounds passage 215. Material 216 may cover apertures 230 of passage 215 and an exterior surface of passage 215. Material 216 may be a permeable material such as a woven, non-woven or knitted material. For example, material 216 may be any suitable mesh material. Material 216 may be a geotextile material. For example, material 216 may be a permeable synthetic material. Material 216 may be formed from any suitable plastic or polymer material such as a polypropylene or polyester material. In at least some exemplary embodiments, material 216 may be a geotextile fabric. Material 216 may be a permeable material (e.g., mesh material) having any suitable mesh opening. For example, material 216 may have a mesh opening of near to or substantially equal to a #20 U.S. sieve. Also for example, material 216 may have any suitable mesh opening size that may allow water to flow from material 7 into cavity 235 via material 216 covering apertures 230, but that may substantially prevent material 7 (e.g., granular components of material 7) from flowing into cavity 235 via material 216 covering apertures 230. In at least some exemplary embodiments, material 216 may have a mesh opening size of between about 400 μm and about 1400 μm, between about 600 μm and about 1200 μm, between about 700 μm and about 1200 μm, between about 800 μm and about 1000 μm, and/or any other suitable mesh opening sizes. In at least some exemplary embodiments, material 216 may have mesh opening sizes that may be dimensioned to be slightly smaller than sand (e.g., slightly smaller than components of material 7 that may be sand). For example, mesh openings of material 216 may be matched to particle sizes of material 7. Flow of a fluid through apertures 230 of passage 215 covered with material 216 may be slower and/or less than flow through apertures 230 that are not covered with material 216.

As illustrated in FIGS. 5A and 5B, passage 215 may rest on an upper surface of the exemplary layer of material 205. A bottom portion of passage 215 may also be disposed partially within the exemplary layer of material 205. In at least some exemplary embodiments, material 216 may be disposed on surface areas of passage 215 that face material 7. For example, material 216 may be disposed on a top surface and side surfaces of passage 215 that directly face material 7. Also for example, a material may be disposed between material 7 and material 205 as described for example below regarding FIG. 7.

As illustrated in FIGS. 5A and 5B, fluid such as water may move from material 205 into cavity 235 via apertures 230 (e.g., apertures 230 disposed at a bottom portion of passage 215). After binder material 214 applied to material 205 has cured, passage 215 may be disposed in cavity 206. Material 7 may then be disposed in cavity 206 (e.g., on top of passage 215 and material 205). Material 7 may be sand or other suitable material as described for example above that surrounds passage 215.

Figure 6:
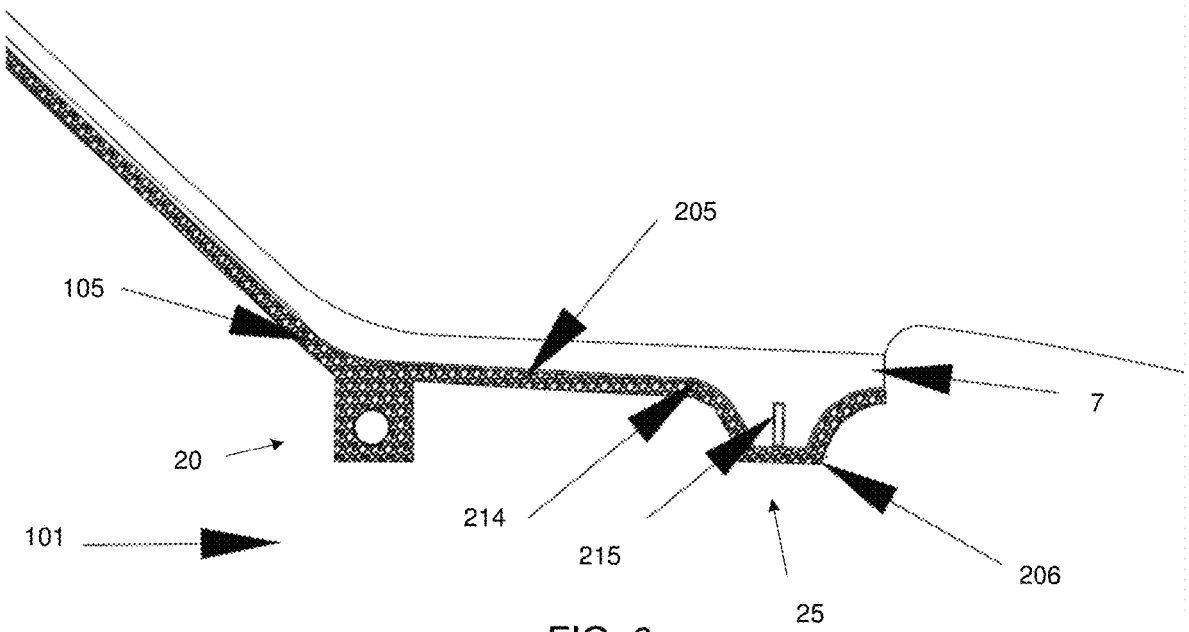
FIG. 6 is a sectional view of at least some exemplary embodiments of the present invention.

FIG. 6 illustrates a profile side view of an exemplary bunker and cavity. Material 101 that may be a subgrade area may have sloping surfaces (e.g., at drainage assembly 20 and at drainage assembly 25) that may be no steeper, e.g., relative to a flat ground surface, than for example angle of repose 111 described above with reference to FIG. 3 (e.g., or described above regarding FIG. 4). Aggregate layers 105 and 205 including exemplary binding material may be disposed above material 101 as described above. Material 7 may be disposed above drainage assembly 25.

Figure 7:
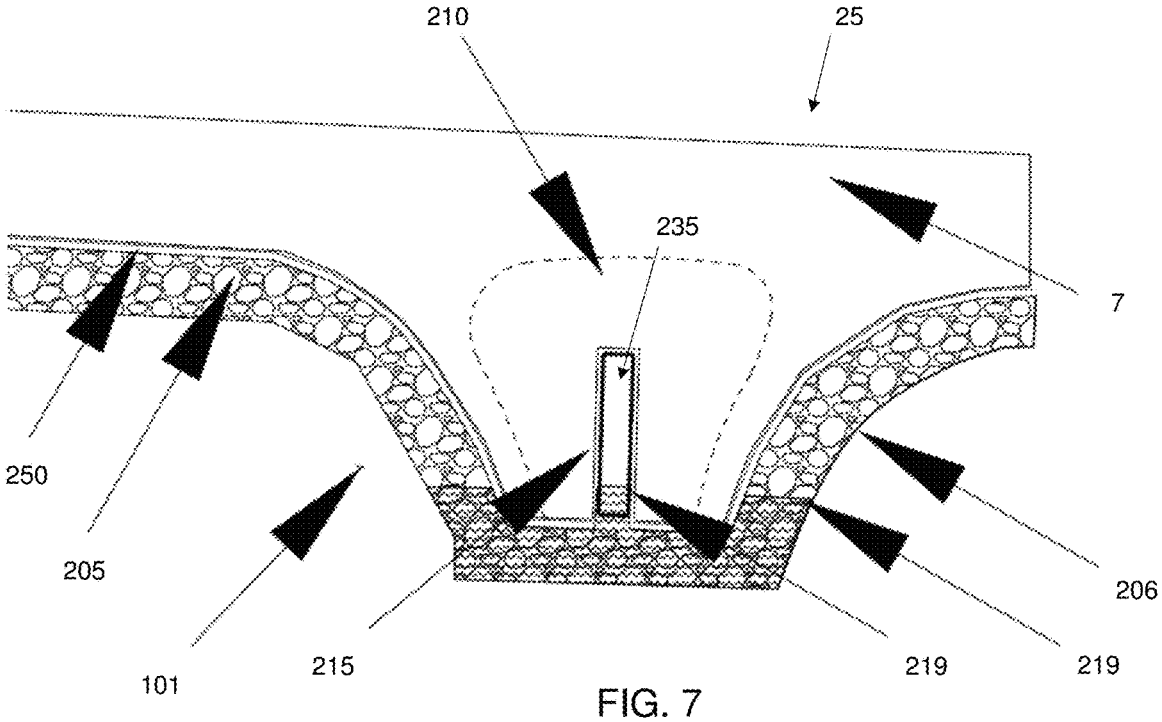
FIG. 7 is a sectional view of at least some exemplary embodiments of the present invention.

FIG. 7 illustrates an exemplary condition in which drainage assembly 25 (e.g., or drainage assembly 25') that may be disposed in portion 18 (e.g., or portion 18') that may be a relatively low (e.g., lowermost) portion of surface layer 5 (e.g., or surface layer 5') is in a water-saturated state or has experienced a water-filled event. A portion 210 may be a seepage area or drainage area that may be saturated with fluid such as water. As described for example above, an angle between a bottom surface of material 101 (e.g., covered with material 205) and each side portion of material 101 (e.g., covered with material 205) may be no steeper for example than angle of repose 111 as described above regarding FIG. 3 (e.g., or described above regarding FIG. 4). In at least some exemplary embodiments, a lower portion of passage 215 may include apertures 230 that may be slots to allow relatively fast movement of fluid such as water upward. A fluid level 219 is illustrated in a saturated or running state. Fluid such as water may move relatively quickly upward as water enters cavity 235 of passage 215 from material 205 via a bottom portion of passage 215 (e.g., that may include apertures 230 but that may not be covered with material 216). Seepage drainage may occur based on fluid such as water moving from material 7 of portion 210 to cavity 235 of passage 215 via apertures 230 that may be covered with material 216 (e.g., at side portions and a top portion of passage 215). Fluid flow through apertures 230 not covered with material 216 (e.g., at a bottom portion of passage 215) may be faster and/or greater than through apertures 230 that are covered with material 216 (e.g., at side portions and a top portion of passage 215). Based on the difference in flow rates due to a presence or absence of material 216 covering apertures 230 as described above, drainage of portion 210 of material 7 may be increased, and portion 210 may not be as wet relative to other portions of material 7 based on an operation of drainage assembly 25 (e.g., or drainage assembly 25').

Figure 8:
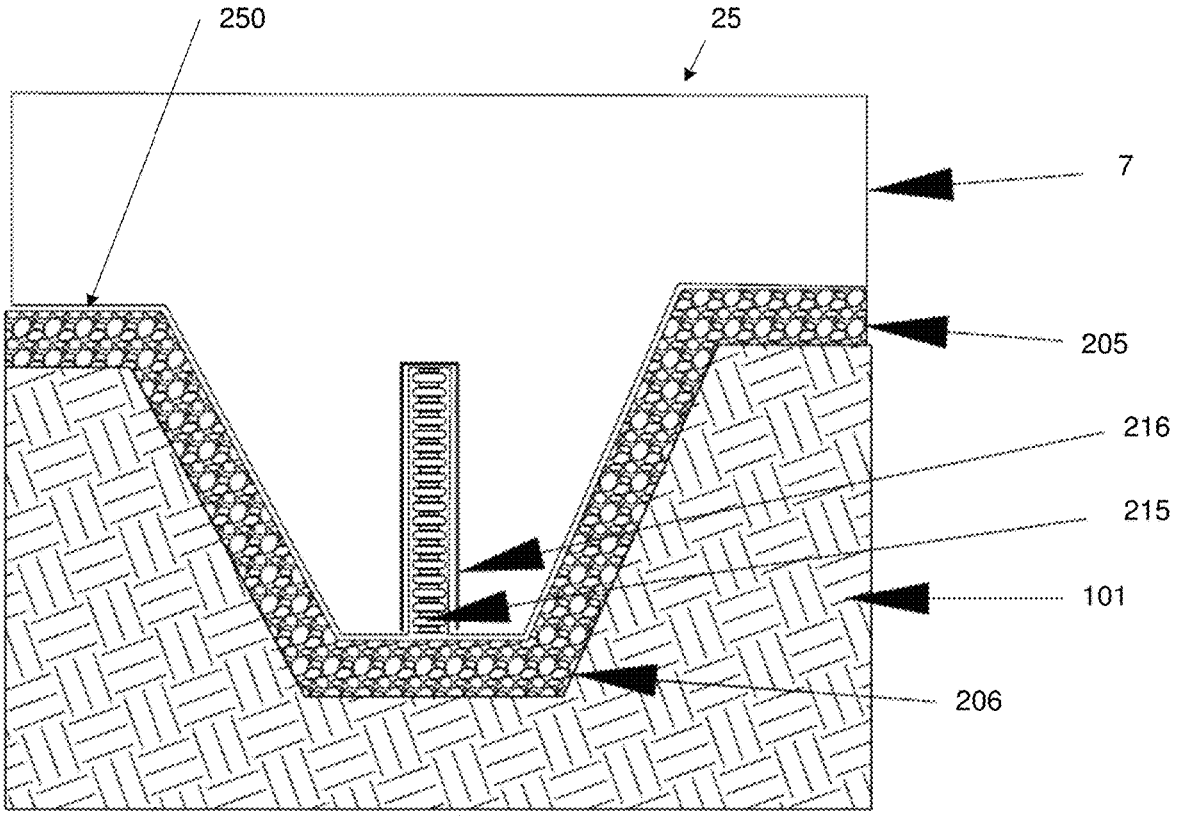
FIG. 8 is a sectional view of at least some exemplary embodiments of the present invention.

In at least some exemplary embodiments and as illustrated in FIGS. 7 and 8, a material 250 may be disposed between material 7 and material 205. Material 250 may be any suitable permeable or semi-permeable member that may help maintain material 7 and material 205 in place relative to each other, and/or control a rate of fluid flow between material 7 and material 205. Material 250 may be made from any suitable material for separating material 7 and material 205 such as, for example, plastic material, polymer material, material similar to material 216, and/or any other suitable material. In at least some exemplary embodiments, material 250 may be permeable or semi-permeable to fluid flow between material 7 and material 205.

Figure 9:
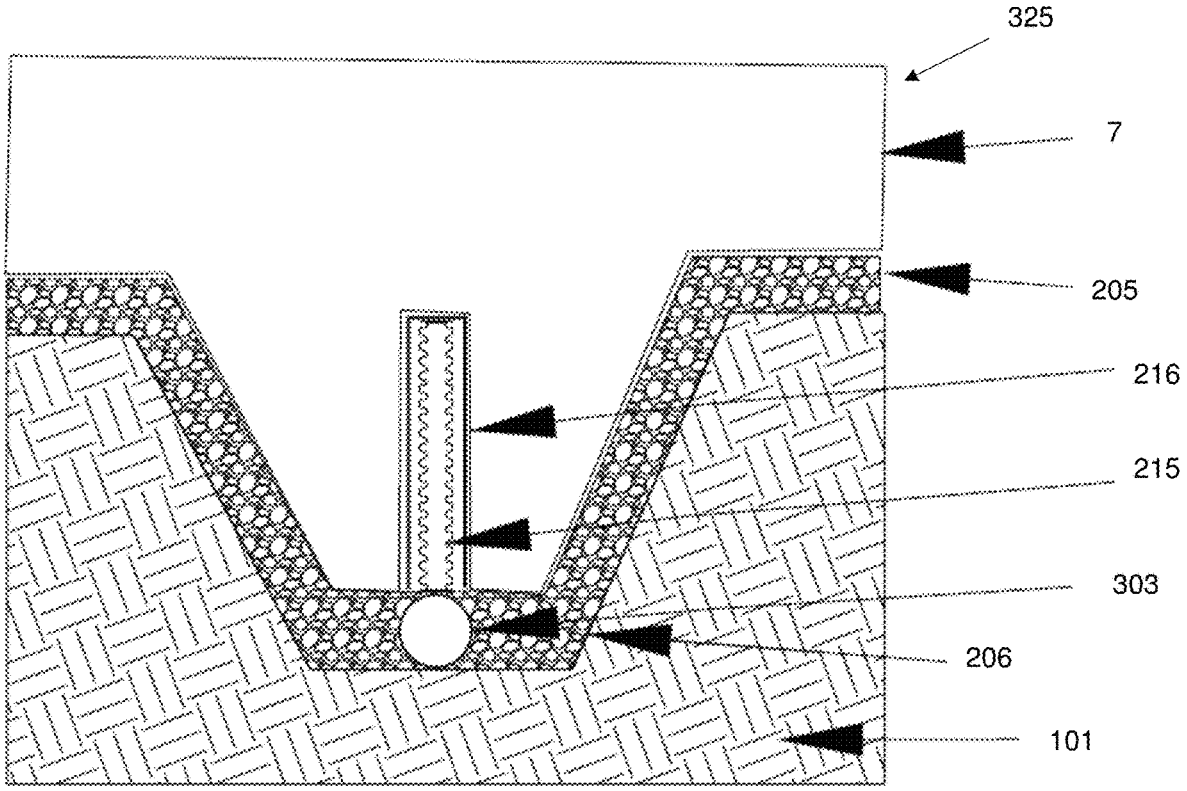
FIG. 9 is a sectional view of at least some exemplary embodiments of the present invention.

FIG. 9 illustrates another exemplary embodiment of the exemplary disclosed drainage assembly. Drainage assembly 325 may be generally similar to drainage assembly 25. Drainage assembly 325 may include a passage 303 that may be disposed below passage 215. Passage 303 may be formed from similar materials as passage 215. In at least some exemplary embodiments, passage 303 may include apertures similar to apertures 230 and be partially or substantially entirely covered with material similar to material 216. Passage 303 may be fluidly connected to passage 215 and may allow for transfer of fluid such as water through the exemplary layer of material 205.

Figure 10:
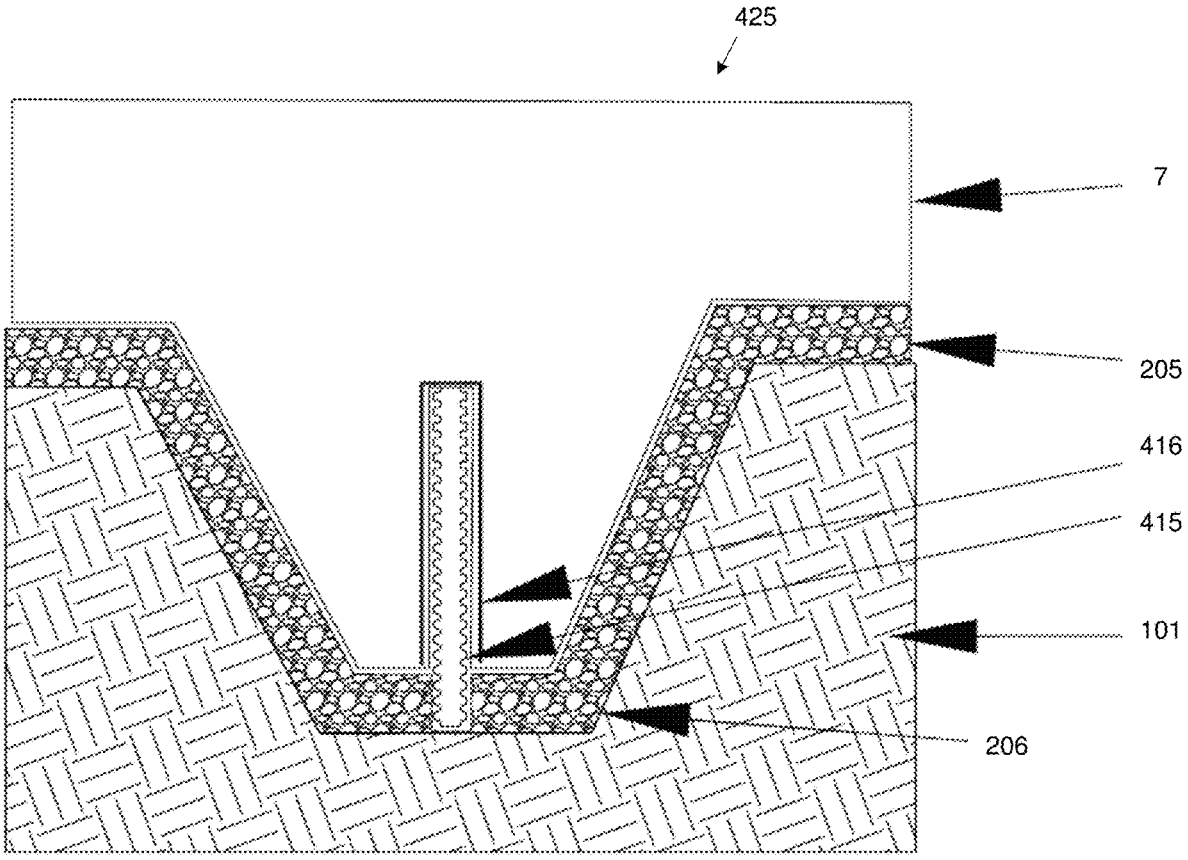
FIG. 10 is a sectional view of at least some exemplary embodiments of the present invention.

FIG. 10 illustrates another exemplary embodiment of the exemplary disclosed drainage assembly. Drainage assembly 425 may be generally similar to drainage assembly 25. Drainage assembly 425 may include a passage 415 that may be generally similar to passage 215. A material 416 that may be generally similar to material 216 may be disposed on passage 415. Passage 415 may extend into material 205 so that passage 415 partially or substantially entirely extends through a depth of the exemplary layer of material 205. In at least some exemplary embodiments based on this exemplary configuration, passage 415 may allow for a faster and/or greater flow of fluid through material 205.

Figure 11A:
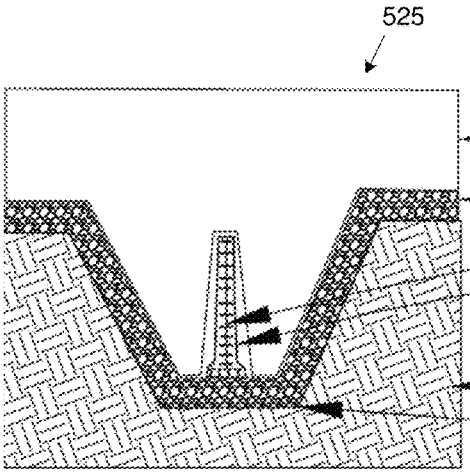
FIG. 11A is a sectional view of at least some exemplary embodiments of the present invention.

FIG. 11A illustrates another exemplary embodiment of the exemplary disclosed drainage assembly. Drainage assembly 525 may be generally similar to drainage assembly 25. Drainage assembly 525 may include a passage 515 that may be generally similar to passage 215. A material 516 that may be generally similar to material 216 may be disposed on passage 515. Passage 515 and material 516 may have the exemplary shape and configuration illustrated in FIG. 11A (e.g., a tapered or trapezoidal shape having a flange-shaped cavity).

Figure 11B:
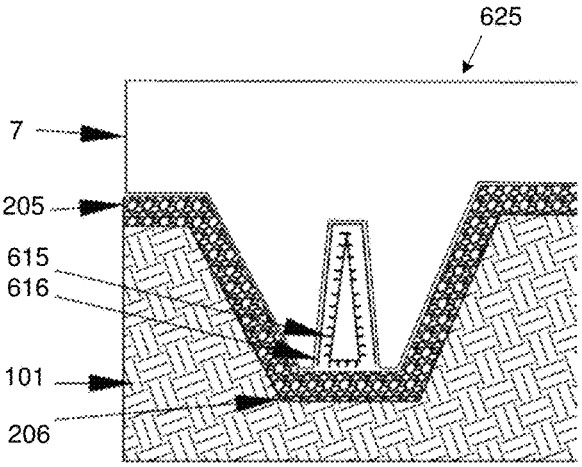
FIG. 11B is a sectional view of at least some exemplary embodiments of the present invention.

FIG. 11B illustrates another exemplary embodiment of the exemplary disclosed drainage assembly. Drainage assembly 625 may be generally similar to drainage assembly 25. Drainage assembly 625 may include a passage 615 that may be generally similar to passage 215. A material 616 that may be generally similar to material 216 may be disposed on passage 615. Passage 615 and material 616 may have the exemplary shape and configuration illustrated in FIG. 11B (e.g., a tapered or trapezoidal shape having a triangular cavity).

Figure 11C:
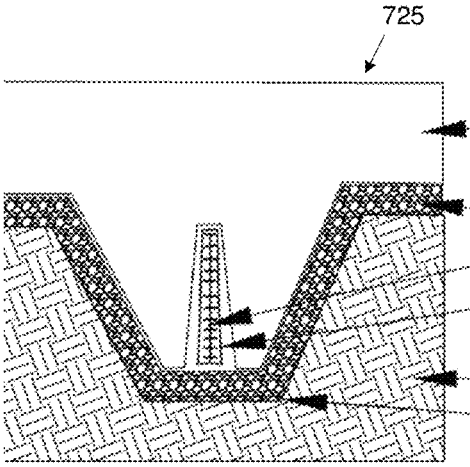
FIG. 11C is a sectional view of at least some exemplary embodiments of the present invention.

FIG. 11C illustrates another exemplary embodiment of the exemplary disclosed drainage assembly. Drainage assembly 725 may be generally similar to drainage assembly 25. Drainage assembly 725 may include a passage 715 that may be generally similar to passage 215. A material 716 that may be generally similar to material 216 may be disposed on passage 715. Passage 715 and material 716 may have the exemplary shape and configuration illustrated in FIG. 11C (e.g., a tapered or trapezoidal shape having a trapezoidal cavity).

Figure 11D:
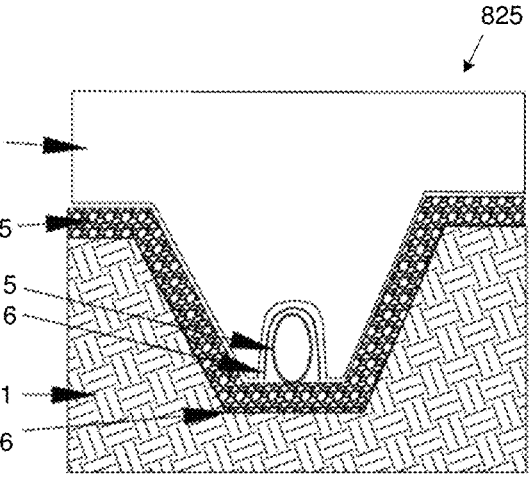
FIG. 11D is a sectional view of at least some exemplary embodiments of the present invention.

FIG. 11D illustrates another exemplary embodiment of the exemplary disclosed drainage assembly. Drainage assembly 825 may be generally similar to drainage assembly 25. Drainage assembly 825 may include a passage 815 that may be generally similar to passage 215. A material 816 that may be generally similar to material 216 may be disposed on passage 815. Passage 815 and material 816 may have the exemplary shape and configuration illustrated in FIG. 11D (e.g., a curved or elliptical shape having a circular cavity).

FIGS. 12A, 12B, and 13 illustrate another exemplary embodiment of the exemplary disclosed drainage assembly. Drainage assembly 920 may be generally similar to drainage assembly 20. A binder material 914 may be applied to material 105 similarly to an application of binder material 214 to material 205 as described above. Drainage assembly 920 may include a layer of a material 913. Material 913 may be an aggregate that is coarser (e.g., has a larger particle size) than material 7 and that is less coarse (e.g., has a smaller particle size) than material 105. Material 913, material 7, and/or material 105 may be sized based on laboratory testing and analysis.

For example, material 105 may be sized to bridge with material 7. In at least some exemplary embodiments, material 105 may be equal to or less than 0.5" in size and may have few fines greater than a 100 mesh (e.g., few fines that are greater than a mesh opening size of about 150 μm). Bridging between material 7 and material 105 may be determined based on a soil sample (e.g., a soil sample taken of a bridging area of material 7 and material 105). In at least some exemplary embodiments, an intermediate aggregate D15 of material 913 (e.g., a size at which 15% of material 913 is finer than that size) may be less than or equal to an intermediate aggregate D15 of material 7 multiplied by 5 (e.g., within a range of +/−5%). This relationship may also be expressed as (material 913) D15≤5×(material 7) D15+/−5%. This relationship may for example be determined based on laboratory tests of soil samples taken from a suitable area at or near drainage assembly 920. Material 913 may be included in any exemplary embodiment disclosed herein including, for example, drainage assembly 20, 20', 25, and 25'.

Figure 14A:
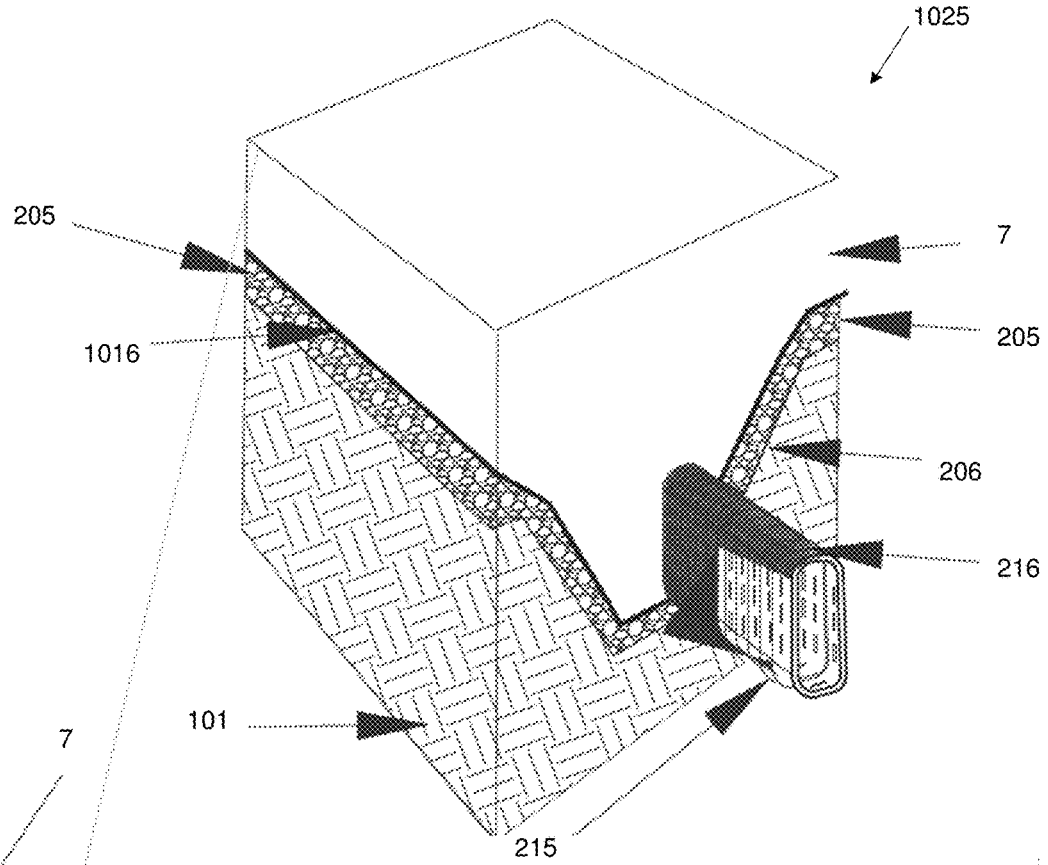
FIG. 14A is a perspective view of at least some exemplary embodiments of the present invention.
Figure 14B:
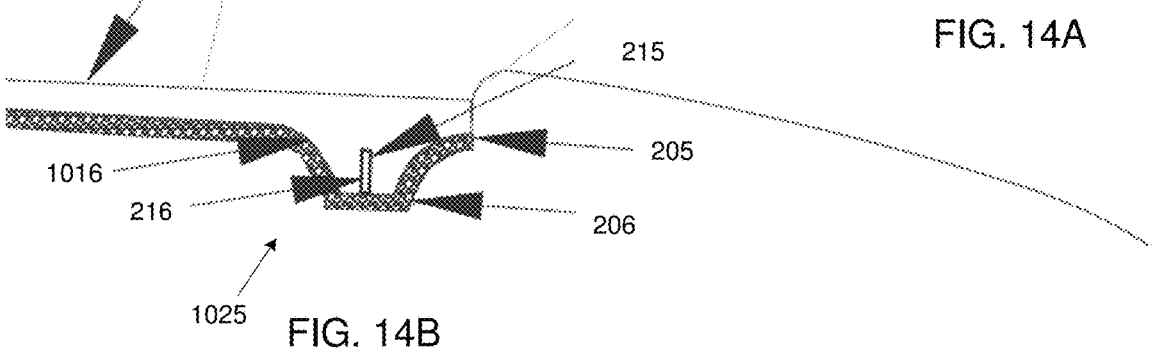
FIG. 14B is a sectional view of at least some exemplary embodiments of the present invention.

FIGS. 14A and 14B illustrate another exemplary embodiment of the exemplary disclosed drainage assembly. Drainage assembly 1025 may be generally similar to drainage assembly 25. Drainage assembly 1025 may include a material 1016 that may be similar to material 216. Material 1016 may be disposed between material 7 and material 205 as illustrated in FIGS. 14A and 14B. Material 1016 may be sized or configured relative to material 7 in a similar manner as material 216 as described above. It is also contemplated that material 1016 may be similar to material 913.

In at least some exemplary embodiments, the exemplary disclosed apparatus, system, and method provides for the construction of one or more drainage systems in surface layers such as surface layers of playing fields that efficiently removes and releases saturated water in the soils of these playing fields. The exemplary disclosed system may include a layer of aggregate (e.g., with or without a binder) and a passage or conduit disposed above the layer of aggregate that may serve as a drainage layer. The layer of aggregate (e.g., material 205) and passage (e.g., passage 215) may be disposed in a cavity such as a trench and surrounded with material such as playing surface material (e.g., sand). The exemplary configuration may allow for relatively fast water movement through the playing surface material (e.g., sand) into the layer of aggregate and into the passage, which may prevent a perched water table from forming. For example, the exemplary seepage-type drainage described above may allow water to move more quickly into a passage based on no perched water table layering being present. Relatively low areas of surface layers may thereby not remain wet or more wet than other portions of the surface layer (e.g., relatively low areas may have sufficient drainage speed). In at least some exemplary embodiments, the exemplary layer of aggregate (e.g., material 205) may serve as a conduit for drainage, and may be covered with a layer of material (e.g., material 7) that may reduce an effect of a perched water table in relatively low portions of surface layers such as sports fields. The exemplary disclosed apparatus, system, and method may maintain relatively high infiltration of fluid such as water through a surface layer, reduce excessive moisture in the surface layer, and reduce maintenance and/or improve a playability of surface layers that may be playing surfaces.

In at least some exemplary embodiments, the exemplary disclosed assembly may include a subgrade material (e.g., material 101) having a bottom surface and at least one side surface that forms an angle with the bottom surface, a first layer of a first material (e.g., material 205), disposed on the bottom surface and the at least one side surface, a passage (e.g., passage 215, 415, 515, 615, 715, or 815) disposed on or in the first layer, and a second layer of a second material (e.g., material 7) disposed above the passage and the first layer. The first material may be coarser than the second material. An angle of repose of the second material may be equal to or steeper than the angle. The passage may be a hollow member including a plurality of apertures that allow a fluid flow from the second layer to a cavity of the hollow member. A membrane material may be disposed on a top surface and a plurality of side surfaces of the passage that is a hollow member, but may not be disposed on a bottom surface of the passage. The membrane material may be a geotextile fabric having a mesh opening of between about 800 μm and about 1000 μm. The membrane material may be a permeable synthetic material having a mesh opening substantially equal to a #20 U.S. sieve. The first material may be gravel and the second material may be sand. The first material may be an aggregate material selected from the group consisting of stone, gravel, crumb rubber, and crushed porcelain. The second material may be sand and the angle of repose of the sand may be measured by an angle of repose measurement device. The angle of repose may be less than or equal to 45 degrees. The first material may include a binder material. The first material may include a binder material when a slope of a top surface of the first layer is greater than 2% or a depth of the second layer is about 7 inches or less. The exemplary disclosed assembly may further include a third layer of a third material disposed between the first layer and the second layer. The third material may be coarser than the second material and the third material may be less coarse than the first material. An intermediate aggregate D15 of the third material may be less than or equal to an intermediate aggregate D15 of the second material multiplied by 5. The exemplary disclosed assembly may further include a second passage disposed in the first layer.

In at least some exemplary embodiments, the exemplary disclosed assembly may include a subgrade material (e.g., material 101) having a bottom surface and a first side surface that forms a first angle with the bottom surface and a second side surface that forms a second angle with the bottom surface, a first layer of a first material (e.g., material 205) disposed on the bottom surface, the first side surface, and the second side surface, a passage (e.g., passage 215, 415, 515, 615, 715, or 815) disposed on or in the first layer, an intermediate layer of an intermediate material disposed on the first layer, and a second layer of a second material (e.g., material 7) disposed on the passage and the intermediate layer. The first material may be coarser than the intermediate layer, and the intermediate layer may be coarser than the second material. The first angle and the second angle may both be less than or equal to the angle of repose of the second material. An intermediate aggregate D15 of the intermediate material may be less than or equal to an intermediate aggregate D15 of the second material multiplied by 5. The exemplary disclosed assembly may be disposed under a golf course and the second material may be golf bunker sand.

In at least some exemplary embodiments, the exemplary disclosed assembly may include a subgrade material (e.g., material 101) having a bottom surface and at least one side surface that forms an angle with the bottom surface, a first layer of gravel (e.g., material 205) disposed on the bottom surface and the at least one side surface, a drainage pipe (e.g., passage 215, 415, 515, 615, 715, or 815) disposed on or in the first layer, a second layer of sand (e.g., material 7) disposed on the drainage pipe and the first layer, and a geotextile fabric covering a top surface and side surfaces of the drainage pipe. The angle may be less than or equal to an angle of repose of the sand. The geotextile fabric may have a mesh opening of between about 800 μm and about 1000 μm. The geotextile fabric may be a permeable synthetic material having a mesh opening substantially equal to a #20 U.S. sieve. The angle of repose may be less than or equal to 35 degrees.

The exemplary disclosed apparatus, system, and method may be used in any suitable application in which drainage of a surface layer is provided. The exemplary disclosed apparatus, system, and method may be used with any suitable surface layer such as, for example, a surface layer of a sports field, golf course, and/or other suitable surface. For example, the exemplary disclosed apparatus, system, and method may be used with a golf putting green, a golf sand trap, a golf bunker, a golf tee green, a golf fairway, and/or any other suitable sports field or playing surface. The exemplary disclosed apparatus, system, and method may also be used with any other suitable applications including surface layers such as landscaping, drainage design, and/or any other suitable application involving drainage of surface layers.

An exemplary method for providing the exemplary disclosed apparatus and system will now be described. The exemplary method may include testing material 7 (e.g., a selected sand) to be used, building a floor of the exemplary surface layer (e.g., surface layer 5 or 5' such as a bunker) to a specific grade, and placing a layer of aggregate (e.g., material 205) over the entire floor of the subgrade (e.g., material 101). The exemplary method may include applying enough binder material (e.g., binder material 214) to the aggregate (e.g., material 205) to bind the material but still remain porous and/or install a nonwoven geotextile fabric (e.g., material 1016) with an approximate mesh opening of near to or equal to a #20 US Sieve, over the area that is not treated with a binder material. The binder material may then be allowed to cure.

An exemplary drainage system (e.g., drainage system 25) as described for example above may be installed. A suitable amount of material 7 (e.g., bunker sand) may then added to surface layer 5, whereby the speed of drainage in the low areas (e.g., portion 18 or portion 18') of the surface layer (e.g., sports area) may be significantly increased. Material 7 (e.g., sports field sand) may be tested to determine a suitable depth of sand. The testing may be performed by placing material 7 (e.g., sand) in a pile, wetting the sand, and waiting 24 hours to determine a desired sand moisture and/or allow a soil laboratory to run a water retention test or column test to read moisture at various depths of material 7 over time. An angle of repose of material 7 may thereby be determined as described for example above regarding FIG. 3.

Material 101 (e.g., subgrade) may be shaped or reshaped so that slopes (e.g., angle 112 and/or angle 140) of material 101 may be equal to or less than the angle of repose (e.g., angle of repose 111) of tested material 7 (e.g., sand) as described for example above regarding FIG. 3. The exemplary excavation cavity (e.g., cavity 206) described above may then be excavated (e.g., excavated at least 12 inches deep). A width of the cavity may be determined by the angle of repose of the gravel (e.g., material 205) and the width of the passage (e.g., passage 215) in lowest areas of the exemplary drainage assembly (e.g., drainage assembly 25 such as a bunker of a sports field). A layer of aggregate (e.g., material 205) may be installed over the entire surface of material 101. The exemplary layer may be at least 2 inches deep. A binder material (e.g., binder material 214) may be applied as described above. The binder material may be allowed to cure. The exemplary passage (e.g., passage 215 and material 216) may be installed. Material 7 may then be added as described for example above. Material 7 may be compacted to a desired amount or level that may be determined based on testing.

In at least some exemplary embodiments, the exemplary method may include testing material 7 (e.g., sand) while dry to determine a maximum angle of repose, and shaping or reshaping of a floor of a sports field to have a bottom of a sports field slope that is equal to or less than the angle of repose of the tested sand. The floor of the sports field may be shaped or reshaped to have a bottom of the slopes and a bottom of the trench sidewalls to be equal to or less than the angle of repose of the tested sand. In at least some exemplary embodiments, a thin layer of intermediate sized aggregates (e.g., material 913) may be placed between material 7 (e.g., sand) and gravel layer (e.g., material 205) that may eliminate a perched water table from forming.

The exemplary disclosed apparatus, system, and method may provide suitable drainage for surfaces such as sports playing surfaces and soil profiles that include a perched water table. The exemplary disclosed apparatus, system, and method may provide an efficient technique for preventing a surface layer from becoming excessively wet, thereby avoiding disease and anaerobic conditions that may cause quick turf decline. The exemplary disclosed apparatus, system, and method may also provide a suitable drying time after rain cycles to achieve suitable playing surface conditions. The exemplary disclosed apparatus, system, and method may also maintain a suitable drainage percolation rate over time. The exemplary disclosed apparatus, system, and method may substantially prevent wash-out of material such as sand from playing surfaces.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

It will be apparent to those skilled in the art that various modifications and variations can be made to the disclosed cutting device and method. Other embodiments will be apparent to those skilled in the art from consideration of the specification and practice of the disclosed method and apparatus. It is intended that the specification and examples be considered as exemplary only, with a true scope being indicated by the following claims.

What is claimed is:

1. A drainage assembly, comprising:

a subgrade material having a bottom surface and at least one side surface that forms an angle with the bottom surface;

a first layer of a first material disposed on the bottom surface and the at least one side surface;

a passage disposed on or in the first layer; and a second layer of a second material disposed above the passage and the first layer;

wherein the first material is coarser than the second material;

wherein an angle of repose of the second material is equal to or steeper than the angle;

wherein a membrane material is disposed on a top surface and a plurality of side surfaces of the passage that is a hollow member, but is not disposed on a bottom surface of the passage.

2. The drainage assembly of claim 1, wherein the passage is a hollow member including a plurality of apertures that allow a fluid flow from the second layer to a cavity of the hollow member.

3. The drainage assembly of claim 1, wherein the membrane material is a geotextile fabric having a mesh opening of between about 800 μm and about 1000 μm.

4. The drainage assembly of claim 1, wherein the membrane material is a permeable synthetic material having a mesh opening substantially equal to a #20 U.S. sieve.

5. The drainage assembly of claim 1, wherein the second material is sand, and the first material is an aggregate material selected from the group consisting of stone, gravel, crumb rubber, and crushed porcelain.

6. The drainage assembly of claim 1, wherein the second material is sand and the angle of repose of the sand is measured by an angle of repose measurement device.

7. The drainage assembly of claim 1, wherein the angle of repose is less than or equal to 45 degrees.

8. The drainage assembly of claim 1, wherein the first material includes a binder material.

9. The drainage assembly of claim 1, wherein the first material includes a binder material when a slope of a top surface of the first layer is greater than 2% or when a depth of the second layer is about 7 inches or less.

10. The drainage assembly of claim 1, further comprising a third layer of a third material disposed between the first layer and the second layer.

11. The drainage assembly of claim 10, wherein the third material is coarser than the second material and the third material is less coarse than the first material.

12. The drainage assembly of claim 10, wherein an intermediate aggregate D15 of the third material is less than or equal to an intermediate aggregate D15 of the second material multiplied by 5.

13. The drainage assembly of claim 1, further comprising a second passage disposed in the first layer.

14. A drainage assembly, comprising:

a subgrade material having a bottom surface and a first side surface that forms a first angle with the bottom surface and a second side surface that forms a second angle with the bottom surface;

a first layer of a first material disposed on the bottom surface, the first side surface, and the second side surface;

a passage disposed on or in the first layer;

an intermediate layer of an intermediate material disposed on the first layer; and a second layer of a second material disposed on the passage and the intermediate layer;

wherein the first material is coarser than the intermediate layer, and the intermediate layer is coarser than the second material;

wherein the first angle and the second angle are both less than or equal to an angle of repose of the second material;

wherein an intermediate aggregate D15 of the intermediate material is less than or equal to an intermediate aggregate D15 of the second material multiplied by 5.

15. The drainage assembly of claim 14, wherein the drainage assembly is disposed under a golf course and the second material is golf bunker sand.

* * * * *